United States Patent [19]

Fedele

[11] 4,341,494

[45] Jul. 27, 1982

[54] VARIABLE-LENGTH REDUCED PIVOT FOR RAILWAY CAR

[75] Inventor: Franco Fedele, Florence, Italy

[73] Assignee: Norca Corporation, Great Neck, N.Y.

[21] Appl. No.: 121,021

[22] Filed: Feb. 13, 1980

[51] Int. Cl.[3] ..... B61D 3/16

[52] U.S. Cl. ..... 410/45; 105/159

[58] Field of Search ..... 410/45; 105/159

[56] References Cited

U.S. PATENT DOCUMENTS 3,788,237 1/1974 Dieckman et al. ..... 410/45

3,837,295 9/1974 Fedele ..... 410/45

*Primary Examiner*—Richard A. Bertsch

*Attorney, Agent, or Firm*—Shenier & O'Connor

[57] ABSTRACT

A reduced-pivot assembly for supporting one end of a load for movement along a track in which a load support member for receiving that end is supported on a truck for lateral movement relative to the way. A limit switch mounted along the longitudinal center line of the truck at a location corresponding to a desired pivot center spaced from the load support center senses the lateral deviation of an adjacent portion of the load support member and actuates lateral shifting apparatus to shift the load support member in such a direction as to achieve the desired pivot center. A plurality of such sensors are disposed at longitudinally spaced locations on the truck to permit variation of the desired pivot center while moving along a track. Other sensors responsive to the lateral movement of the load support member inhibit the operation of the lateral shifting apparatus whenever the lateral displacement of the load support member exceeds a predetermined safe limit.

7 Claims, 7 Drawing Figures

VARIABLE-LENGTH REDUCED PIVOT FOR RAILWAY CAR

BACKGROUND OF THE INVENTION

In the conventional railway load supporting system the load is pivotally carried on spaced wheel trucks at load support centers so that when the train negotiates a curve the trucks pivot relative to the load at the support centers. When extremely long loads, such as large electrical transformers and bridge beams, are transported by rail, the load is supported adjacent each of its ends between relatively widely separated sets of running gear. While such an arrangement is satisfactory under normal straight running conditions, when the load must negotiate a relatively sharp curve the load swings inboard for such a distance that it will either strike a wayside obstacle or it will be unable to negotiate the curve.

Various schemes have been proposed in the prior art for overcoming the problem outlined above of enabling long and wide loads to negotiate curves without striking roadside obstacles. It has, for example, been suggested that removable pins can be inserted through the supporting beams and into the running gear at points inboard of the support centers to cause the load to swing around pivot centers separated by a lesser distance than are the load support centers.

Another arrangement which has been proposed is to provide a surface on the running gear bolster to which the load is applied and which permits sliding or rolling movement between the member carrying the load and the bolster surface. In such an arrangement, there is provided a rigid beam connecting the member applying the load to a pin or the like at the point on the bolster inboard of the load point at which it is desired to have the load pivot.

In yet another arrangement, described in my prior patent, U.S. Pat. No. 3,837,295, each end of the load is supported on a bolster carried by the running gear by means of an arcuate sliding connection comprising a transversely extending arcuate way and an arcuate slide disposed in the way and connected to the load so as to constrain the load to swing about a pivot point which is the center of the arc of movement of the sliding connection. While this last arrangement has been successful, it has the disadvantage of requiring an independent lateral shifting device in order to clear certain obstacles.

Further, all of these "reduced pivot" arrangements, as they are often called, suffer the drawback that the effective pivot center is either fixed or is adjustable only by stopping the train and performing a suitable manual operation such as inserting pivot pins. Thus for a non-stop run, the pivot center is effectively fixed. Since the selection of a pivot center involves a compromise between competing considerations of clearance and car stability, operation on atypical track portions will be less than optimum. For example, if the car assembly is operating on a track portion with a rapidly changing curvature, the rapid lateral shifting of the load support center due to the reduced pivot may result in overloading of the outside wheels. Under such conditions, uniformity of axle load becomes more important than clearance.

SUMMARY OF THE INVENTION

One of the objects of my invention is to provide a reduced-pivot assembly for a railway car in which the effective pivot center may be varied to accommodate different track conditions.

Another object of my invention is to provide a reduced-pivot assembly which avoids excessive lateral shifting or overloading of the outside set of wheels.

Still another object of my invention is to provide a reduced-pivot assembly which is adjustable without stopping the train.

A further object of my invention is to provide a reduced-pivot assembly which resists longitudinal forces.

Yet another object of my invention is to provide a reduced-pivot assembly which is mechanically simple.

Other and further objects of my invention will be apparent from the following disclosure.

In general, my invention contemplates a reduced-pivot assembly for supporting one end of a load for movement along a track or way in which a load receiving member is mounted on a truck for lateral movement relative to the way. A sensor senses the deviation of the actual pivot center, or intersection of the longitudinal center lines of the truck and the load receiving member, from the desired center, and the member is then laterally shifted in such a direction as to move the actual pivot center toward the desired pivot center.

Preferably the sensor comprises a suitable device, such as an optical or mechanical switch, which is carried by one of the load receiving member and truck at a location corresponding to the desired pivot center and which senses the lateral deviation of an adjacent portion of the other of the load receiving member and truck from a location corresponding to the desired pivot center. Preferably the assembly also has either a longitudinally adjustable sensor or a plurality of longitudinally spaced sensors so as to permit variation of the desired pivot center while moving along a track. Preferably the assembly further includes a sensor for sensing the lateral displacement in either direction exceeds a predetermined safe limit, as may occur on a sharply curving track section.

Because my reduced-pivot assembly relies on servo control rather than on a mechanical pivot or slide to establish the desired pivot center, I am able to vary the desired center while the car is moving to accommodate changing track conditions. Further, since manually controlled lateral shifting apparatus is often included as a standard feature of existing reduced-pivot assemblies, my assembly entails little additional complexity or expense except for the position sensors.

BRIEF DESCRIPTION OF THE DRAWINGS

In the accompanying drawings to which reference is made in the instant specification and in which like reference characters are used to indicate like parts in the various views:

FIG. 3 is an enlarged fragmentary side elevation of one section of the car shown in FIG. 1, with some parts in section.

DETAILED DESCRIPTION OF THE PREFERRED EMBODIMENT

Figure 1:
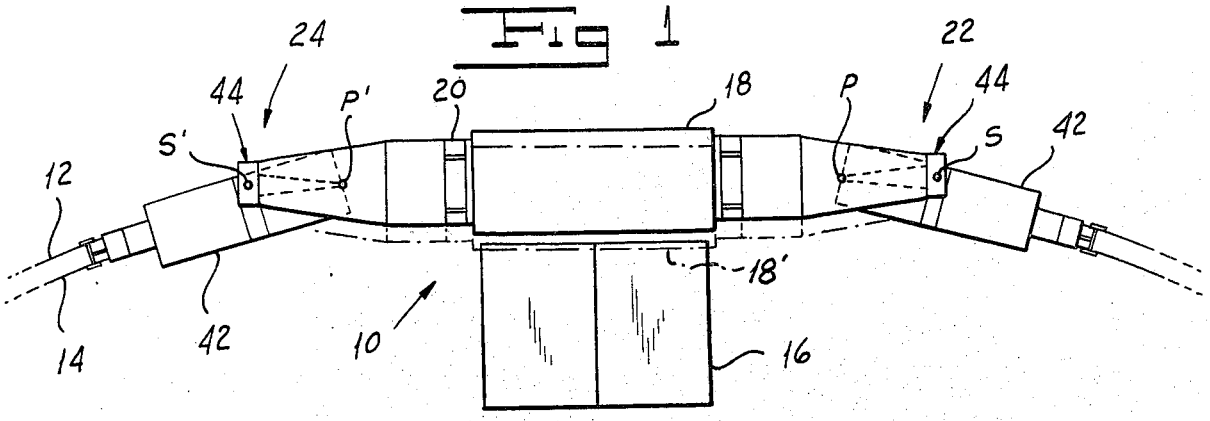
FIG. 1 is a top plan of a railway car incorporating my variable-length reduced-pivot assembly, shown while negotiating a curve.

Referring now to the drawings, a railway car using my reduced-pivot assembly, indicated generally by the reference numeral 10, is adapted to ride along a pair of parallel tracks 12 and 14 past an obstruction 16 adjacent to the tracks. A load 18 such as an oversize transformer rests on a carrier 20 supported at its ends by a forward car section indicated generally by the reference numeral 22 and an after car section indicated generally by the reference numeral 24. Since the forward car section 22 and the after car section 24 are similarly constructed, the remaining discussion will be with reference to the after car section 24.

The forward running gear of the after car section 24, indicated generally by the reference numeral 26, comprises a forward intermediate bolster 30 supported at the rear end thereof by a four-wheel truck 32 and at the forward end by a forward lower bolster 34, which bolster is in turn supported at the ends thereof by two additional four-wheel trucks 32. In a similar manner, the after running gear of the forward car section 22, indicated generally by the reference numeral 28, comprises an after intermediate bolster 36 supported at the front end thereof by a four-wheel truck 38 and at the rear end thereof by an after lower bolster 40, the bolster 40 being supported at the ends thereof by two additional four-wheel trucks 38. Forward intermediate bolster 30 and after intermediate bolster 38 support opposite ends of a span bolster 42. It will be appreciated from the above description that the weight supported by span bolster 42 is distributed equally among the 24 wheels making up trucks 32 and 38.

Span bolster 42 in turn carries a load support assembly, indicated generally by the reference numeral 44, for pivotal movement around a load support center S'. Load support assembly 44 comprises a lower section 46 and an upper section 48 provided with respective telescoping cylindrical portions 50 and 52 to permit vertical sliding movement of the upper section 48. Respective front and rear vertical jacks 54 and 56 disposed between portions of sections 46 and 48 permit adjustment of the height of the upper section 48 to provide additional vertical clearance if necessary. A vertical pivot 58 allows rotational movement between the lower section 46 and a lateral slide 60 which is slidably received in a transverse way 62 formed across the span bolster 42. Respective springs 64 and 66 disposed between the slide 60 and the lower section 46 on each side of the vertical pivot 58 resiliently maintain the load support assembly 44 in a relatively upright position. Respective strips 68 and 70 formed from polytetrafluoroethylene or other low friction material disposed between springs 64 and 66 and the lower section 48 allow for sliding movement when the section 46 rotates on the pivot 58.

To prevent the lateral slide 60 from lifting out of the transverse way 62, the slide 60 includes transversely running keys 74 which are slidably received in lateral guides 72 formed along the front and rear of the transverse way 62. Respective front and rear lateral jacks 76 and 78, the cylinders of which are attached to the guide 72 and the piston rods of which are attached to the span bolster 42, are actuated in a manner to be described to move the entire assembly 44, from the lateral slide 60 upward, transversely with respect to the span bolster 42.

The lower section 46 of the load support is formed with a center beam 80 extending longitudinally in the direction of the load 18. Respective switches 84 and 86 carried at longitudinally spaced locations on a longitudinal strip 82 attached to the span bolster 42 each coact with the center beam 80 in such a manner that the movable switch contact is moved against one fixed contact when the center beam 80 moves in one transverse direction relative to the strip 82 and is moved against the other fixed switch contact when the center beam 80 moves in the other transverse direction beyond a predetermined limit. The movable contact of each of switches 84 and 86 is coupled to one terminal of a voltage source 88 such as an on-board generator.

Figure 4:
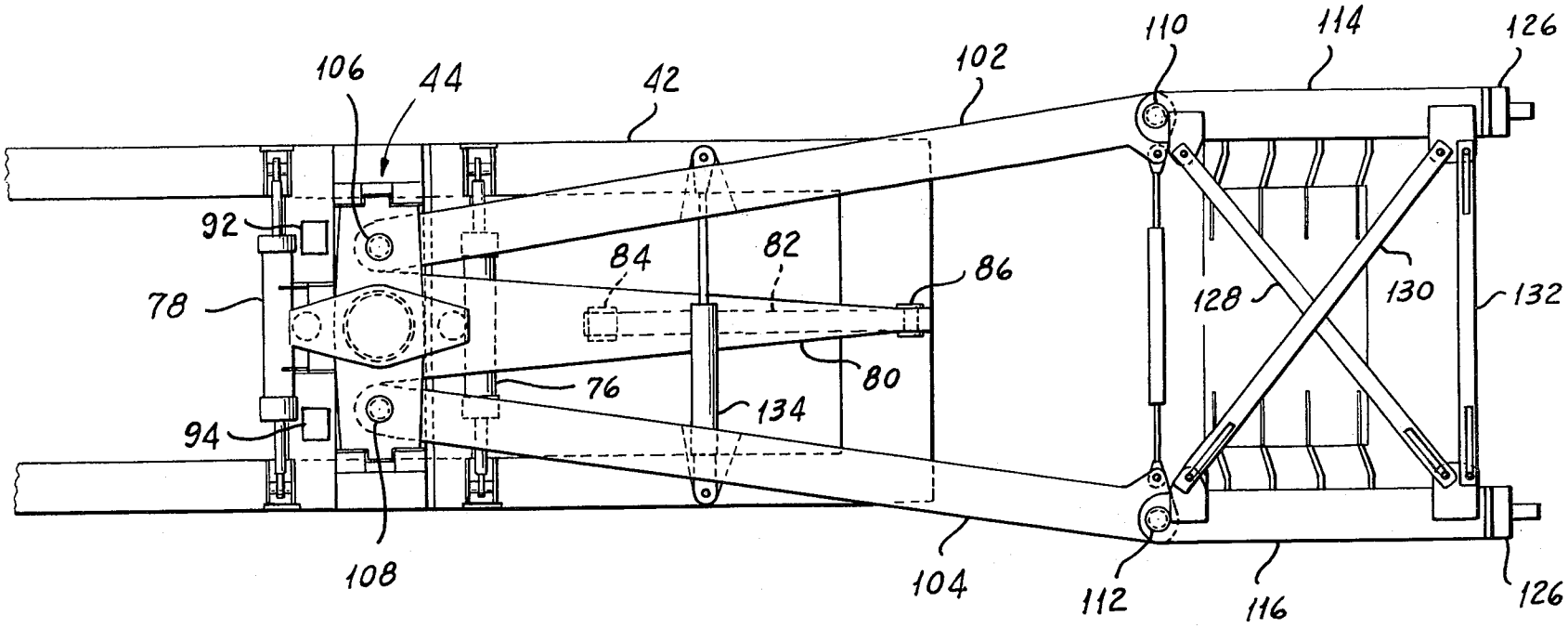
FIG. 4 is an enlarged fragmentary top plan of the car section shown in FIG. 3.
Figure 5:
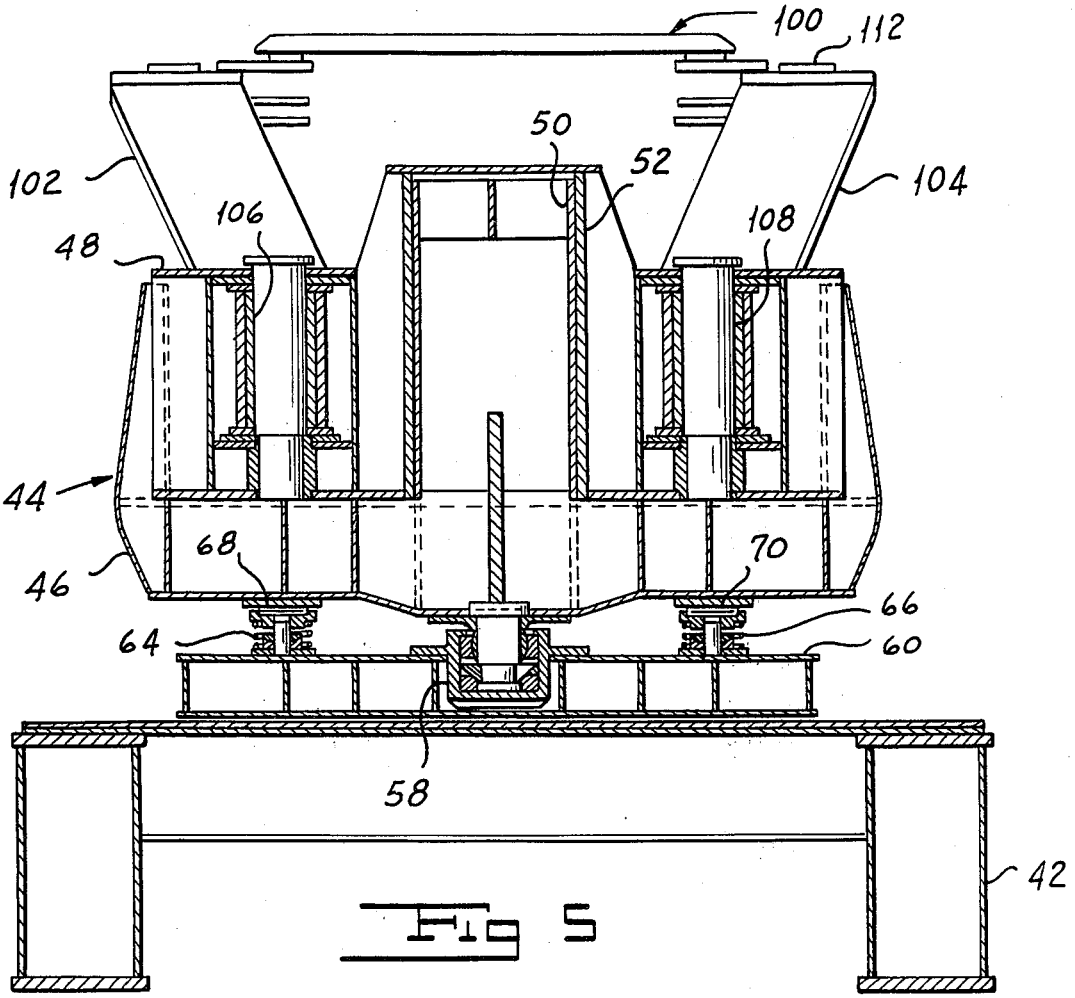
Figure 6:
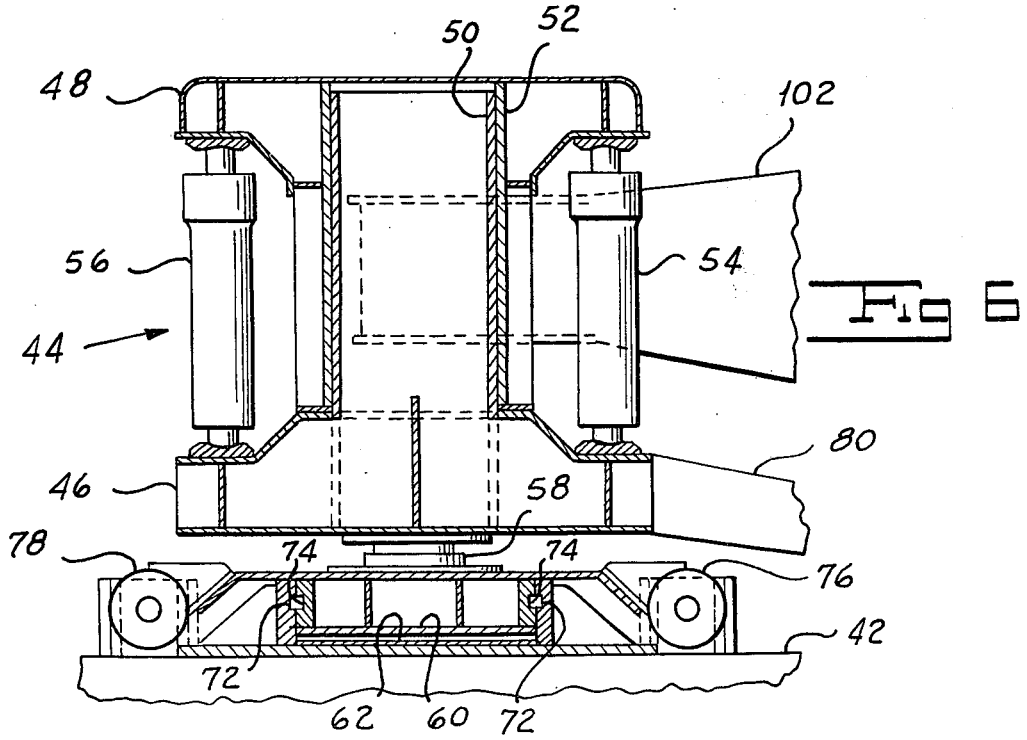
FIG. 6 is a further enlarged view of the load support assembly of the car section shown in FIG. 3.

One pair of the fixed contacts of switches 84 and 86 are coupled to the fixed contacts of one switch element of a double-pole double-throw selection switch 90. Likewise, the other pair of fixed contacts of switches 84 and 86 are connected to the fixed contacts of the other switch elements of double-pole double-throw switch 90. The movable contacts of switch 90 are coupled through respective normally closed limit switches 92 and 94 to inputs to respective solenoid-controlled valves 96 and 98, the other inputs to which are coupled to the other terminal of voltage source 88. Valve 96 actuates lateral shifting jacks 76 and 78 to move load support assembly 44 to the left as seen in FIG. 4, while valve 98 actuates the jacks to move the load support assembly 44 to the right. Control valves 96 and 98 are thus controlled through the 2 meter switch 84 when selection switch 90 is in one position and are controlled by the 4.8 meter switch 86 when the selection switch 90 is in the other position.

Each of the load support assemblies 44 supports one end of the carrier 20 through a triangular beam or "schnabel" assembly indicated generally by the reference numeral 100. More particularly, each assembly 100 comprises a pair of transversely spaced triangular beams 102 and 104 secured to the upper section 48 of load support assembly 44 by means of respective transversely spaced vertical pins 106 and 108. Triangular beams 102 and 104 are secured at their other ends to respective parallel beams 114 and 116 through another pair of pins 110 and 112. Respective openings 118 formed at the lower ends of parallel beams 114 and 116 receive hinge pins 120 coupling them to the carrier 20. Respective pairs of compression jacks 122 have rods 124 connected to pads 126 which are adapted to be moved to engagement with the ends of the load 18 so as to position the load on the carrier 20 as well as prevent the carrier 20 from sagging.

A width-adjusting jack 134 extending between triangular beams 102 and 104 is actuated to vary the transverse spacing between the ends of the beams 102 and 104 remote from the load support assembly 44. The intermeshing portions of parallel beams 114 and 116 permit purely transverse motion of the beams relative to each other. Diagonally extending slotted crossbars 128 and 130 and transversely extending slotted crossbar 132 limit the transverse displacement of the parallel beams 114 and 116 to a predetermined range.

Figure 2:
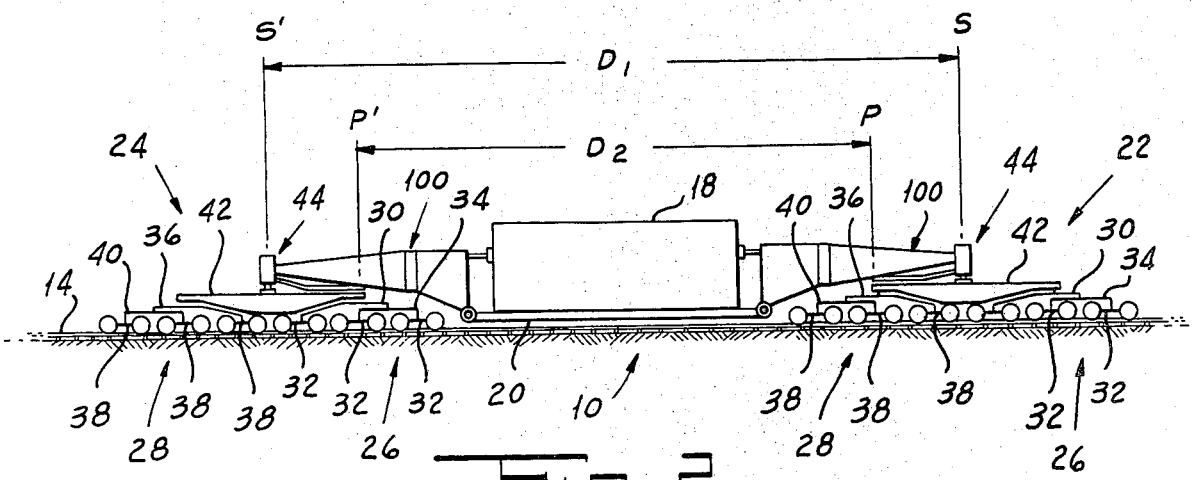
FIG. 2 is a side elevation of the car shown in FIG. 1.

The operation of my reduced-pivot assembly is typically as follows. Assume that the car 10 is initially moving to the right as seen in FIGS. 1 and 2 along a straight section of track. At this time, load support centers S and S' are in undisplaced positions along the center line of the span bolsters 42 and the center beams 80 in alignment with the limit switches 84 and 86 and supporting strip 82. Assume further that selection switch 90 is in the right, or 4.8 meter, position. If the car 10 now moves into a right curve, as shown in FIG. 1, the span bolsters 42 and load support assemblies 44 will move out of angular alignment, and center beams 80 will swing to the right side of span bolsters 42, closing the upper contacts of switches 86. Closure of these switch contacts energizes the solenoid control valves 96 associated with the respective lateral shifting assemblies, in turn actuating lateral shifting jacks 76 and 78 to move the load support assemblies 44 to the left side of span bolsters 42 and load 18 clear of obstruction 16. When the load support assemblies 44 are moved to a sufficient extent to align the center lines of beams 80 with the limit switches 86, the switch contact reopens, shutting off valves 96 and the shifting jacks 76 and 78. Thus, regardless of the exact degree of curvature of the tracks 12 and 14, the load support assemblies 44 will pivot around effective pivot centers P and P′ determined by the longitudinal position of the actuated limit switch 86. By contrast, if the lateral shifting assemblies had remained inactive, the effective pivot centers would have coincided with load support centers S and S′, and the load 18 would have swung outwardly to a position 18′, hitting the obstruction 16.

Assume now that the car 10 leaves the curved track section and re-enters a straight section of track. When this happens, load support assemblies 44 will move back into angular alignment with respective span bolsters 42. Since, however, the load support assemblies have previously been shifted laterally to the left of the center lines of span bolsters 42, this angular realignment will cause the respective center beams 80 to swing to the left of the center lines of span bolsters 42, closing the lower contacts of switches 86 and energizing the solenoid-controlled valves 98. As a result, lateral shifting jacks 76 and 78 are again energized, this time to move the load support assemblies toward the right so that the load support centers S and S′ are realigned with the longitudinal center lines of span bolsters 42. When this happens, center beams 80 become realigned with limit switches 86, reopening the switch contacts to deactuate the lateral shifting jacks 76 and 78.

Figure 7:
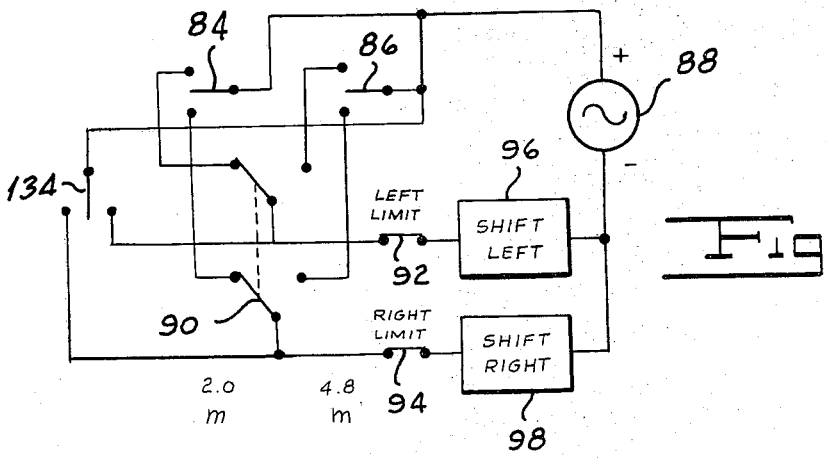
FIG. 7 is a schematic diagram of one form of control circuit that may be used for my variable-length reduced-pivot assembly.
Figure 5:
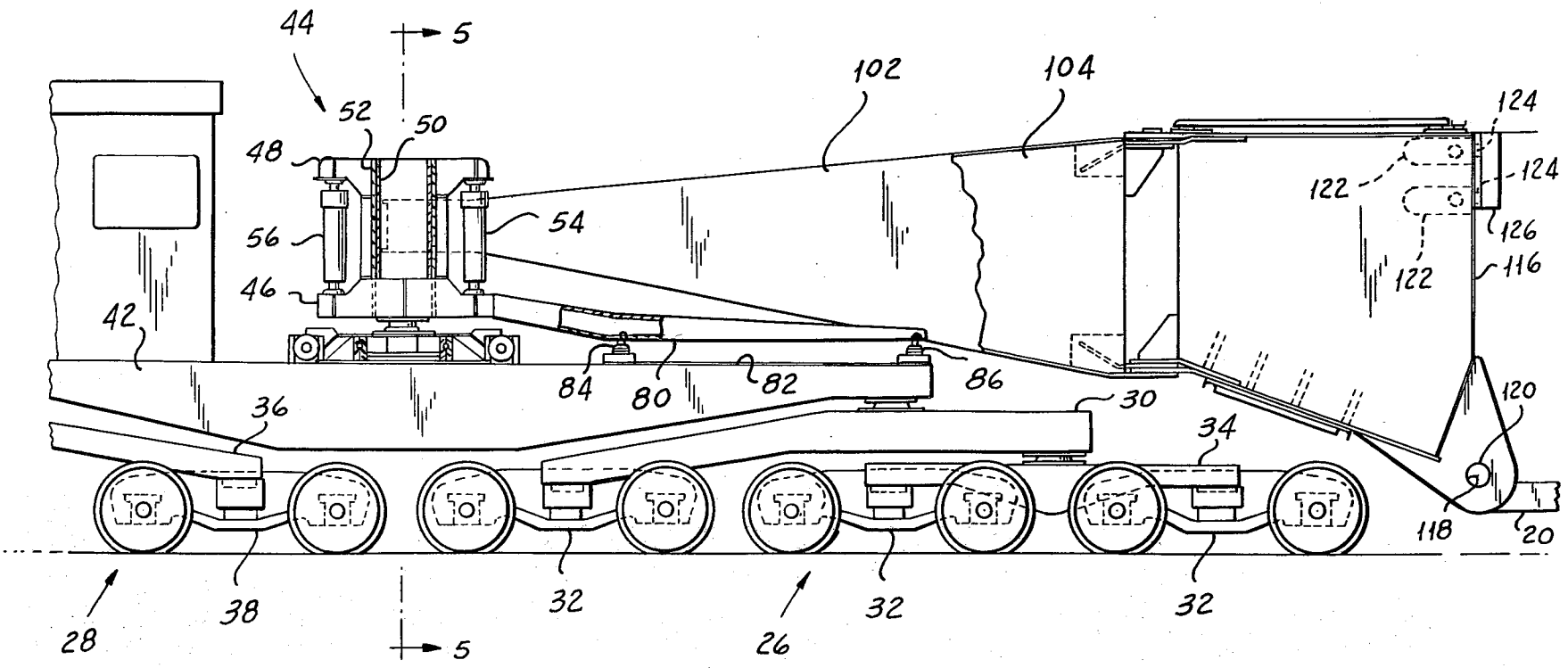
FIG. 5 is a further enlarged fragmentary section of the car section shown in FIG. 3, taken along line 5—5.

If the operator of the car 10 wishes to establish different pivot centers, for example, pivot centers 2 meters inboard of the load support center S and S′, he simply moves selection switch 90 to the left as shown in FIG. 7 so that switches 84 rather than switches 86 control the solenoid-controlled valves 96 and 98. Such a changeover may, as previously stated, be made while the car 10 is moving along tracks 12 and 14, and no mechanical recouplings are required. Further, if desired, the system may include a manually actuable single-pole double-throw switch 134 coupled in parallel with switches 84 and 86 to permit manual actuation of the shifting jacks 76 and 78 if either of the switches 84 and 86 fails or if an exceptional obstacle is encountered.

While in the preferred embodiment I use hydraulic jacks to accomplish lateral shifting, other expedients such as screw drive may also be used. Further, while I have used mechanically actuated switches to sense the lateral position of the load support assembly at the desired pivot center, it is also possible to use optical sensors either by themselves or as a backup system.

It will be seen that I have accomplished the objects of my invention. My reduced-pivot assembly allows the effective pivot center to be varied to accommodate changing track conditions. My assembly avoids excessive lateral shifting or overloading of the outside set of wheels. My reduced-pivot assembly is adjustable without stopping the train and resists longitudinal forces. Finally, my assembly is mechanically simple.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. An assembly for supporting a load for movement along a way including in combination a truck having wheels adapted to move along said way, a member for receiving said load on a load support center, means for supporting said member on said truck for lateral movement relative to said way, said truck and said member having longitudinal center lines, a plurality of sensors disposed at respective locations along the longitudinal center line of one of said member and said truck spaced from said load support center, each of said sensors being operable to sense the lateral displacement of an adjacent portion disposed along the center line of the other of said member and said truck, means adapted to be actuated to shift said member laterally relative to said truck, and means responsive to a selected one of said sensors for actuating said lateral shifting means to shift said member in such a direction as to reduce the lateral displacement sensed by said sensor.

2. An assembly for supporting a load for movement along a way including in combination a truck having wheels adapted to move along said way; a member for receiving said load on a load support center; means for supporting said member on said truck for lateral movement relative to said way, said member comprising an upper section, a lower section, means for raising said upper section relative to said lower section, and a beam carried by said lower section extending longitudinally from said load support center, said beam and said truck having respective portions located at a desired pivot center spaced from said load support center; means mounted on one of said portions for sensing the lateral displacement of the other of said portions; means adapted to be actuated to shift said member laterally relative to said truck; and means responsive to said sensing means for actuating said lateral shifting means to shift said member in such a direction as to reduce said lateral displacement.

3. An assembly for supporting a load for movement along a way including in combination a truck having wheels adapted to move along said way, a member for receiving said load on a load support center, means for supporting said member on said truck for lateral movement relative to said way, said member having a beam extending longitudinally from said load support center, said beam and said truck having respective portions located at a desired pivot center spaced from said load support center, means mounted on one of said portions for sensing the lateral displacement of the other of said portions, means adapted to be actuated to shift said member laterally relative to said truck, and means responsive to said sensing means for actuating said lateral shifting means to shift said member in such a direction as to reduce said lateral displacement.

4. An assembly for supporting a load for movement along a way including in combination a truck having wheels adapted to move along said way, a member for receiving said load on a load support center, means for supporting said member on said truck for lateral movement relative to said way, said means including a lateral slide carried by one of said member and said truck and means forming a lateral way on the other of said member and said truck at said location for receiving said slide for sliding movement, said truck and said member having respective portions located at a desired pivot center spaced from said load support center, means mounted on one of said portions for sensing the lateral displacement of the other of said portions, means adapted to be actuated to shift said member laterally relative to said truck, and means responsive to said sensing means for actuating said lateral shifting means to shift said member in such a direction as to reduce said lateral displacement.

5. An assembly for supporting a load for movement along a way including in combination a truck having wheels adapted to move along said way, a member for receiving said load on a load support center, means for supporting said member on said truck for lateral movement relative to said way, said truck and said member having respective portions located at a desired pivot center spaced from said load support center, means mounted on one of said portions for sensing the lateral displacement of the other of said portions, means adapted to be actuated to shift said member laterally relative to said truck, means responsive to said sensing means for actuating said lateral shifting means to shift said member in such a direction as to reduce said lateral displacement, and means for inhibiting the lateral movement of said member beyond a predetermined limit.

6. An assembly for supporting a load for movement along a way including in combination a truck having wheels adapted to move along said way, a member for receiving said load on a load support center, means for supporting said member on said truck for lateral movement relative to said way, said truck and said member having respective portions located at a desired pivot center spaced from said load support center, means mounted on one of said portions for sensing the lateral displacement of the other of said portions, means adapted to be actuated to shift said member laterally relative to said truck, and means responsive to said sensing means for actuating said lateral shifting means to shift said member in such a direction as to reduce said lateral displacement.

7. An assembly for supporting a load for movement along a way including in combination a truck having wheels adapted to move along said way, a member for receiving said load on a load support center, means for supporting said member on said truck for lateral movement relative to said way, said truck and said member having respective portions located at a desired pivot center spaced from said load support center, means mounted on one of said portions for sensing the lateral displacement of the other of said portions, said sensing means producing a first electrical output in response to a predetermined lateral displacement in a first direction and producing a second electrical output in response to a predetermined lateral displacement in a second direction, means adapted to be actuated to shift said member laterally relative to said truck, and means responsive to said sensing means for actuating said lateral shifting means to shift said member in such a direction as to reduce said lateral displacement, said lateral shifting means being responsive to said first output to shift said member in said second direction and being responsive to said second output to shift said member in said first direction.

* * * * *